United States Patent [19]

Lorenz

[11] Patent Number: 4,486,271

[45] Date of Patent: Dec. 4, 1984

[54] COKE OVEN DOOR HAVING A LAMINATED SEALING STRIP

[75] Inventor: Kurt Lorenz, Hattingen, Fed. Rep. of Germany

[73] Assignee: Firma Carl Still GmbH & Co. KG, Fed. Rep. of Germany

[21] Appl. No.: 516,270

[22] Filed: Jul. 22, 1983

[30] Foreign Application Priority Data

Jul. 24, 1982 [DE] Fed. Rep. of Germany ..... 3227733

[51] Int. Cl.[3] ..... C10B 25/06; C10B 25/16

[52] U.S. Cl. ..... 202/248; 202/269

[58] Field of Search ..... 202/248, 269; 110/173 R; 49/480

[56] References Cited

U.S. PATENT DOCUMENTS

| | | | |
|---|---|---|---|
| 2,812,292 | 11/1957 | Tucker | 202/248 |
| 3,933,598 | 1/1976 | Pries | 202/248 |
| 4,028,193 | 6/1977 | Nagayoshi | 202/269 |
| 4,115,203 | 9/1978 | Naevestad | 202/248 |
| 4,217,177 | 8/1980 | Gerding et al. | 202/248 |
| 4,387,004 | 6/1983 | Prins | 202/269 |

FOREIGN PATENT DOCUMENTS

| | | | |
|---|---|---|---|
| 940343 | 3/1956 | Fed. Rep. of Germany | 202/248 |
| 422182 | 10/1933 | United Kingdom | 202/248 |

OTHER PUBLICATIONS

Battelle Columbus Labs; "Development and Demonstration of Concepts for Improving Coke-Oven Door Seals", Aug. 1978.

*Primary Examiner*—Bradley Garris

*Attorney, Agent, or Firm*—McGlew and Tuttle

[57] ABSTRACT

A coke oven door is equipped with a metallic sealing strip extending therearound and providing a tight seal for the coke oven. The sealing strip is a compound structure of thin layers or laminations of corrosion-resistant, preferably 0.5 mm thick sheet material. The individual layers are welded to one another at their edges, and, especially if the sealing strip is designed as a sectional diaphragm, a knife-edged sealing blade is provided on the free side of the sealing strip, which blade is pressed into tight contact with the door frame by means of thrust plungers, for example. Due to its laminated structure, the sealing strip is capable of taking up hammering without becoming permanently deformed.

15 Claims, 5 Drawing Figures

COKE OVEN DOOR HAVING A LAMINATED SEALING STRIP

FIELD AND BACKGROUND OF THE INVENTION

This invention relates in general to coke ovens and in particular to a new and useful coke oven door sealing strip construction.

Prior art coke oven doors employed for sealing horizontal coke oven chambers are pressed against the door frame by means of pressure or tensioning springs, in order to prevent the gases produced in the chamber during the carbonization from escaping. For this purpose, the door body is equipped with metallic sealing strips extending along the periphery of the door and designed as flat elements having a sharpened edge, or as angle shapes, for example Z diaphragms (German Pat. No. 23 09 032). The free edges, or legs of these sealing strips are properly loaded by springs which are mounted in housings or similar structures, to bring the sealing edge of the sealing strips into a tight contact with the door frame.

Prior art sealing strips, particularly those designed as non-sectional flat bars, are held in pressure contact with the door frame by clamping devices, primarily hook bolts, and are driven forward by hammering. The Z sections provided in the German Pat. No. 23 09 032 may be driven forward substantially in the same way, by hammering, provided that they are held in position at the door frame through suitable devices and loaded at their edges by spring-loaded thrust plungers. U-section and Z-section sealing strips are known from German Pat. No. 28 45 045.

While adjusting or forcing prior art sealing strips, particularly sectional ones, into contact with the foor frame by hammering, they frequently become so deformed that they no longer can serve their purpose and must be exchanged. This is to be done particularly if even very strong hammering cannot establish a satisfactory tight contact with the door frame, along the entire periphery, or in partial areas. Since their initial shape cannot be restored without substantial costs, and since also their range of resilient action becomes too small, they are replaced by new ones as a rule, which entails considerable maintenance and capital costs.

SUMMARY OF THE INVENTION

The invention is directed to a coke oven door equipped with a sealing strip which will not be deformed even under strong hammering and has a structure which may be used in straight or bent configuration.

To this end, the invention provides that the sealing strip is a compound structure assembled of a plurality of thin layers or laminations.

Surprisingly, such a sealing strip is capable of withstanding even strong hammering substantially better than a keen-edged, flat steel sealing strip. If a sectional sealing strip is employed, the wide range of resilient action makes it possible to readily maintain the initial shape even under forceful or even too forceful hammering. Then, a hitherto frequent change of sealing strips becomes unnecessary and is reduced to an extent corresponding to normal wear. In addition, due to the particular shape of both straight and sectional sealing strips, the individual hammer strokes are advantageously transmitted also into the door frame, so that accretions may be destroyed in a simpler way and more securely.

In one embodiment of the invention, the layers of the sealing strip are formed by metal sheets having a thickness from 0.2 to 0.8 mm, preferably 0.5 mm. These sheets are to be non-positively secured, in juxtaposition or superimposed, to the door body through holding means known per se, and they may, as mentioned above, easily be driven forward together and uniformly parallel to the oven axis by hammering or by other suitable devices.

The uniform arrangement and driving of the individual laminations forming the sealing strip is ensured, in accordance with the invention, by conncting them at their ends, preferably by welding. It has been found, surprisingly, that it suffices to join the laminations to one another by spot or line connections at the respective edges to ensure that an intimately united compound structure is obtained. It may be advantageous to connect the free edge zone of the laminations to a sealing blade which is made in one piece and uniformly applies against the door frame and may have a knife edge. Such a sealing blade acts also as a kind of wear protection for the individual laminations.

The individual layers or laminations may be made from V2A metal sheets or a similar material, temperature conditions permitting. An advantageous embodiment provides laminations of a non-corrosive material unsensitive to stress cracking, for example a chrome molybdenum titanium alloy. A sealing strip of such material has a long life, since it resists aggressive gas components. Such aggressive gas components might penetrate into the material and cause corrosion, particularly if sectional sealing diaphragms are provided which change their position as the coke oven door is removed or put in place.

Under proper conditions, it is advantageous to employ compound sealing strips assembled of two to ten, preferably five layers. With such a number of layers, especially five layers, the life of the strip is surprisingly extended, as compared to conventional ones.

The multi-layer strip having its layers welded together at the edges, may advantageously be mounted on the door body in a shaped configuration, such as bent to a U, Z, or double-Z diaphragm, and pressed into contact with the door frame in its free edge zone by means of spring loaded thrust plungers. The strips, substantially of identical structure, may thus be used as both straight and bent or shaped sealing strips. Individually or in groups, they only must be given the corresponding shape. The spring-loaded thrust plungers acting on the edge zones of the strips then ensure that the sealing knife edge applies accurately and with the necessary pressure against the door frame.

To obtain an exactly central loading of the sealing knife edge by the thrust plungers, it is advantageous to design the free edge zone of the sealing strip with a continuous sealing blade which is knife-edged and connected to the front face of the compound strip in substantially perpendicular, transverse position, and to let the thrust plungers load this sealing blade. It is advisable to connect the sealing blade to the compound strip by welding, which may be done in a relatively inexpensive way at the site, i.e. at the coke oven. Of course, such strips may be welded in advance in the shop and the properly mounted.

To facilitate particularly the connection of the sealing blade with the compound strip, it is advantageous to design and manufacture the blade as a drawn or pressed shape having a corresponding protrusion connectable to the layers of the strip. With such design, the sealing blade is formed in a single operation and the connection, particularly welding, to the layers of the strip is simplified.

To securely prevent the sealing blade or sealing strip from resiliently rebounding as the coke oven door is extracted, it is advisable to make the sealing blade connectable to the thrust plungers. In this way, any resetting forces of a bent sealing strip may be compensated for or suppressed. The extension or outward travel of the thrust plungers must be limited, of course.

With an automatic coke oven operation, the coke oven doors are frequently cleaned mechanically. To prevent overloading or damaging of the sealing strips during such an operation, a protective strip may be provided in front of the sealing strip, at the oven side. This makes it easily possible to clean the sealing edge itself by means of cleaning knives without damaging the layers of the sealing strip.

A simplified mounting of a protective strip may be obtained in accordance with the invention by designing the sealing blade with a protrusion to which the protective strip can be welded, or to provide a protective strip in the shape of an L strip or bar having its short leg welded to the sealing blade and its long, free leg extending close up to the door body. This long or wide free leg to some extent also provides a protection by restraining the rebounding of a bent sealing strip. The protective strip may also be designed and manufactured as an integral portion of a drawn or pressed shape of the sealing blade formed with a protrusion for the strip layers.

The particular inventive feature is to provide a coke oven door with a sealing strip and sealing edge performing its function reliably and not deforming upon being adjusted by hammering or by means of thrust screws, thus having a long life and, in practice, not requiring any maintenance of the coke oven door. In addition, the invention makes it possible to provide modern cleaning mechanisms and knives without thereby loading or damaging the sealing edges or the entire sealing strip. Also, the inventive sealing strips may be mounted both in straight and shaped position, no separately designed strips are needed in this respect.

Accordingly, it is an object of the invention to provide an improved sealing strip which is adapted to seal a coke oven door with a coke oven frame which is made up of a plurality of layers of corrosion resistant metal which is welded together and has one end which is adapted to be clamped by a clamping mechanism and an opposite end which is adapted to have a knife-edged portion which is pressed by the clamping mechanism of the door against the door frame.

A further object of the invention is to provide a coke oven sealing arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
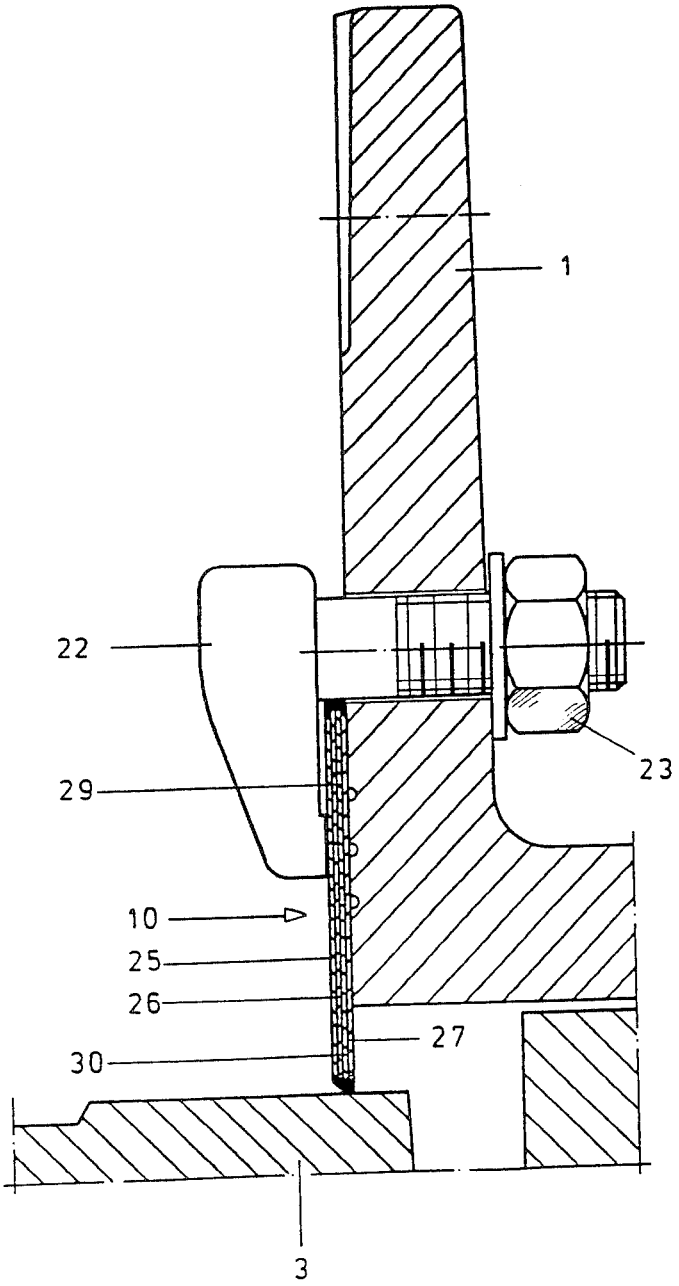
FIG. 2 is an enlarged sectional view showing the sealing area between the door body and the door frame, with the mounted sealing element being a straight strip.

Referring to the drawings in particular the invention embodied therein comprises a coke oven closure construction for sealing a coke oven door or door body generally designated 1 to its associated coke oven door frame 3 which comprises a sealing strip generally designated 10 which is carried by the door 1 and which is made up in accordance with the invention of a plurality of corrosion resistant metal layers which are welded together. The sealing strip has an end portion which is adapted to be clamped by a clamping mechanism 4 carried by the door and its opposite end carries an integral or separate knife edge or sealing blade 11 which in one embodiment comprises a separate element or which may be a formation of the plates themselves as indicated in FIG. 2.

Figure 1:
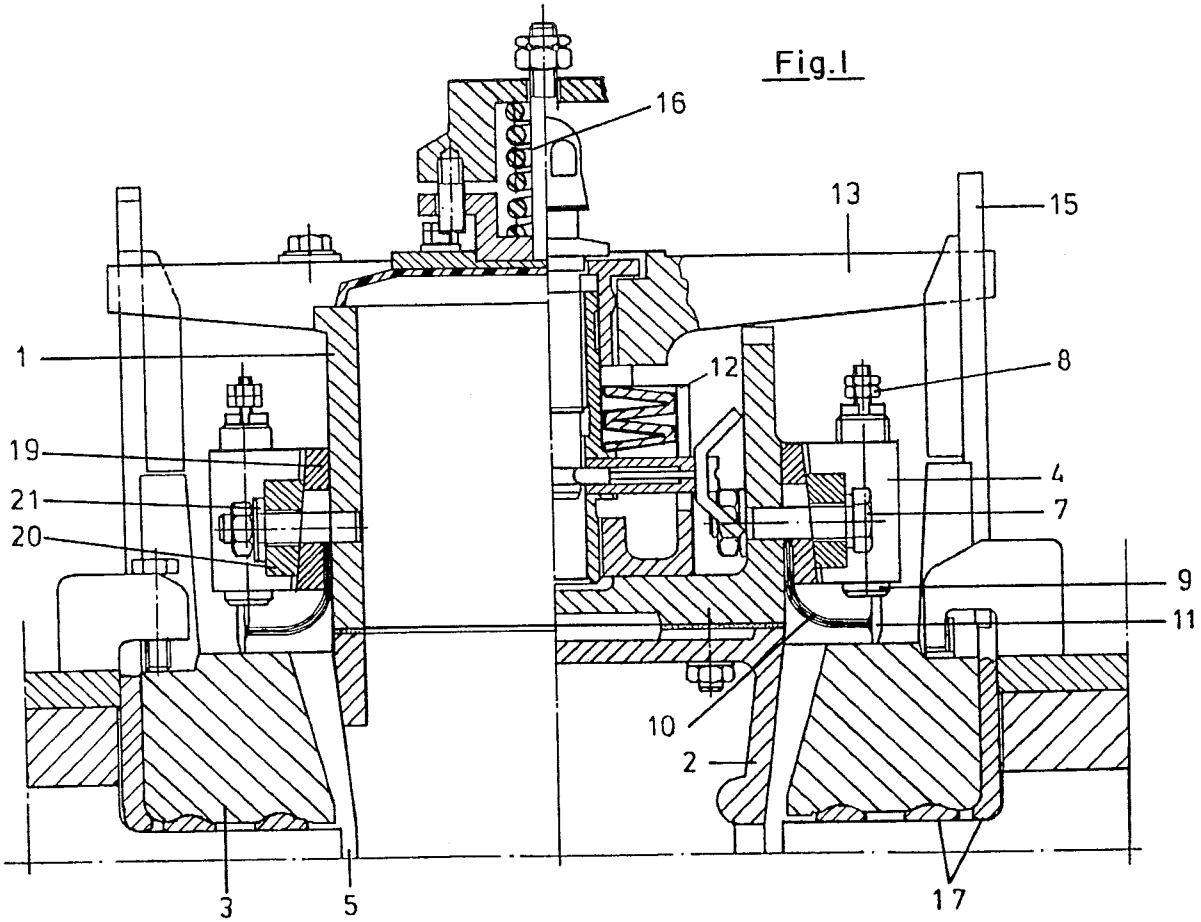
FIG. 1 is a partial sectional view of a coke oven door inserted in a door frame and constructed in accordance with the invention.

FIG. 1 shows the door body 1 carrying a plug holder 2 and tightly put in place against door frame 3. The clamping mechanism 4 provides for a tight contact between door 1 and frame 3, ensuring that no gases from coke oven 5 escape into the atmosphere. Clamping mechanism 4 is secured to door body 1 by a clamping screw 7. By means of a tightening screw 8, a spring-loaded thrust plunger 9 accommodated in a spring housing is pressed against the front end of a sealing strip 10 which terminates in a knife-edged sealing blade 11. This, along with a clamping of the entire coke oven door, ensures that sealing blade 1 provides the tight contact needed for closing the coke oven 5. The overall clamping of the coke oven door against the door frame is obtained through a pressure spring 12, a latch bar 13, and hooks which are anchored in door frame 3. The clamping force can be adjusted by correspondingly adjusting pressure spring 12. Seals 17 prevent a leak of gases through the joint between door frame 3 and coke oven 5.

In the embodiment of FIG. 1, clamping mechanism 4 comprises a wedge 19 which is displaceable by hammering, and an opposite wedge plate 20. While driving wedge 19 with hammer strokes, wedge plate 20, which is clamped through a spring washer 21, slides into respective balancing positions, so that wedge 19 and thus sealing strip 10 are secured against resetting forces. Wedge 19 and wedge plate 20 are secured to door body 1 by means of the screw or clamping bolt 7.

The sealing strip 10 shown in FIG. 1 is a preshaped sectional sealing strip which is provided on its end at right angles with a knife-edge sealing blade 11. The sealing blade 11 is loaded by the thrust plunger 9 which forms a part of wedge 19 and is fixed to door body 1 along therewith by the clamping bolt 7.

The sealing strip 10 in the embodiment of FIG. 2 is a straight sealing element. Strip 10 is clamped to door body 1 by means of a bolt hook 22 and a nut 23. Sealing strip 10 comprises individual superposed layers 25,26,27. The individual layers 25,26,27 are welded to each other in their edge zones 29,30. Edge zone 29 is tightly clamped to door body 1 by bolt hook 22 and held in place by friction, while the free edge zone 30 terminates in a knife-edge or is connected to a knife-edged blade. Such a sealing knife edge or blade 11, i.e., the suitably shaped free edge zone 30, applies tightly against door frame 3 and, as sealing strip 10 is hammered, causes a destruction of dirt, incrustations or accretions which might have formed on the sealing surface.

Figure 3:
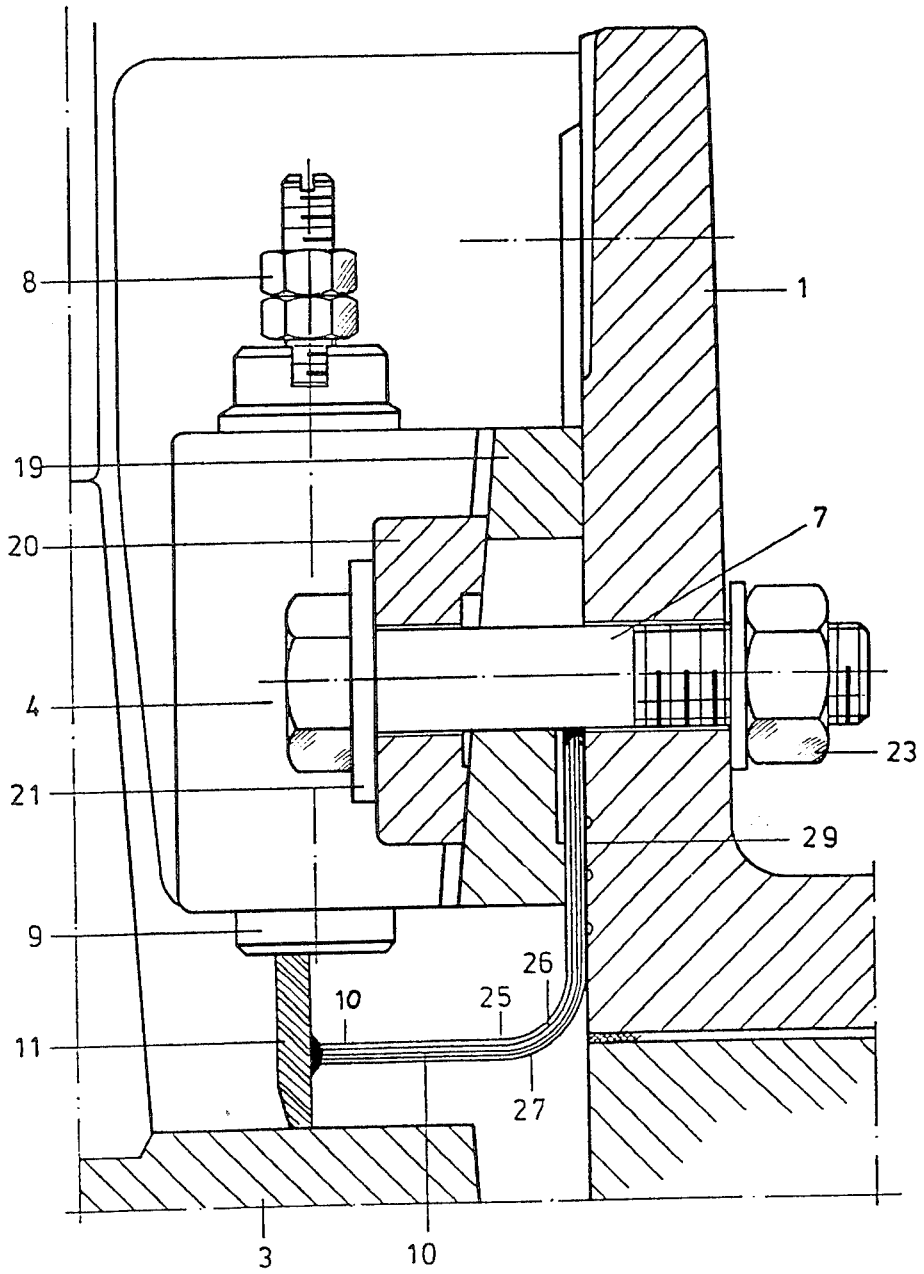
FIG. 3 is a view similar to FIG. 2 showing the sealing strip of FIG. 1 in detail.

FIG. 3 shows in detail a sealing strip 10 in accordance with FIG. 1. It may be seen that the bent layers 25, 26, 27 are clamped by their edge zone 29 to door body 1, by means of clamping mechanism 4, and connected, i.e. welded, on their other edges to a sealing blade 11 extending perpendicularly thereto.

Figure 4:
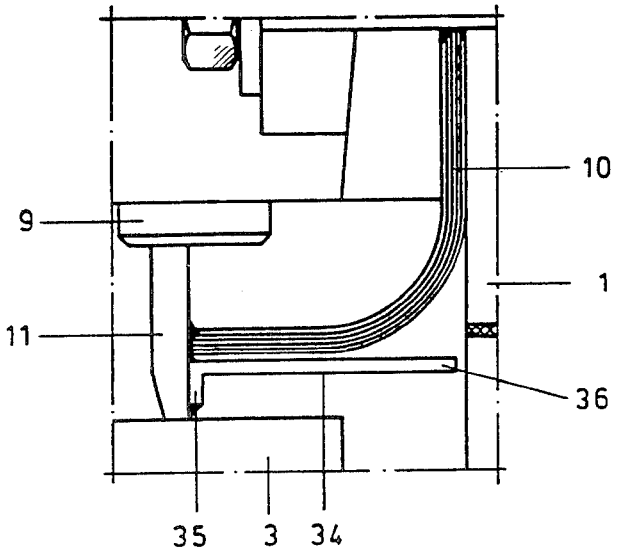
FIG. 4 is a sectional view showing another embodiment comprising a shaped sealing strip with a protective strip.

To protect the correspondingly mounted and designed sealing strip 10, a protective angle strip 34 is provided, as shown in FIG. 4, having its short leg 35 welded to the sealing blade, while its free leg 36 extends close up to door body 1. Here again, sealing blade 11 is loaded by thrust plunger 9 and pressed into contact with door frame 3. Sealing blade 11 may be connected to thrust plunger 9 in a manner securely preventing sealing strip 10, thus layers 25,26,27 from rebounding upon extracting the coke oven door from coke oven 5.

Figure 5:
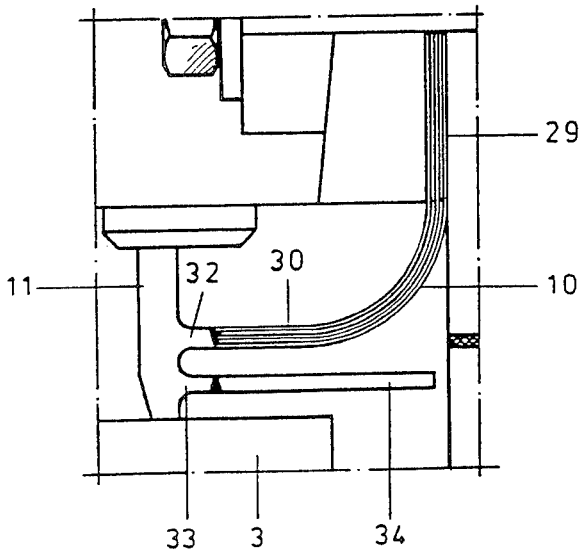
FIG. 5 is a similar view showing a protective strip made integral with the sealing blade.

The embodiment shown in FIG. 5 facilitates the mounting of sealing strip 10 and sealing blade 11. In this embodiment, sealing blade 11 is designed as a drawn or pressed shape having protrusions 32 and 33 for connecting or welding thereon sealing strip 10 or the set of layers 25, 26, 27, and protective strip 34, in a particularly easy manner. Protrusion 33 is intended for protective strip 34.

While specific embodiments of the invention have been shown and described in detail to illustrate the application of the principles of the invention, it will be understood that the invention may be embodied otherwise without departing from such principles.

What is claimed is:

1. A coke oven door construction for sealing an opening in a coke oven defined by a coke oven door frame, comprising:

a door body;

a sealing strip carried by said door body and extending around said door body, said sealing strip adapted for engagement to a coke oven door frame, said sealing strip formed of from two to ten juxtaposed metal layers each having a thickness of from 0.2 to 0.8 mm, each of said metal layers made of corrosion-resistant material which is resistant to stress cracking, each layer having a first end and a second end respectively adjacent a first end and a second end of said sealing strip, each of said first ends of said layers being welded together and each of said second ends of said layers being welded together, said sealing strip having a knife edge end portion at said second end of said sealing strip mounted for movement with respect to said door body and adapted for engagement with the coke oven door frame; and a clamping mechanism connected to said door body and engaged with said first end of said sealing strip and each of said first ends of said layers, for clamping said first end of said sealing strip and said layers to said door body.

2. A coke oven door construction according to claim 1, wherein said knife edge end portion comprises said second welded ends of said metal layers.

3. A coke oven door construction according to claim 1, wherein said layers of said sealing strip are made from chrome molybdenum titanium alloy.

4. A coke oven door construction according to claim 1, wherein five layers form said sealing strip.

5. A coke oven door construction according to claim 4 wherein each of said layers has a thickness of 0.5 mm.

6. A coke oven door construction according to claim 1, wherein said clamping mechanism includes a thrust plunger movable against said knife edge end portion and adapted to press it against a door frame.

7. A coke oven door construction according to claim 6 wherein said knife edge end portion comprises a separate knife edge member extending substantially normal to said second end of said sealing strip, said knife edge member welded to said second end of said sealing strip and engaged by said thrust plunger, and a protective strip welded to said knife edge member and extending toward said door body on a side of said knife edge member away from said thrust plunger for shielding said sealing strip from an opening of a coke oven to be closed by said door body.

8. A coke oven door construction according to claim 7 wherein said knife edge member is connected to said thrust plunger.

9. A coke oven door construction according to claim 1, wherein said knife edge end portion comprises a separate knife edge member disposed substantially normal to said second end of said sealing strip.

10. A coke oven door construction according to claim 9, wherein said knife edge member has a side portion with a protrusion connected to said sealing strip layers.

11. A coke oven door construction according to claim 10 including a plunger axially movable in said clamping mechanism having an end engaged with said knife edge member and biasing means engaged with said plunger and connected to said clampling mechanism for biasing said knife edge member into a direction away from said clamping mechanism for urging said knife edge member into engagement with a coke oven door frame.

12. A coke oven door construction according to claim 11 including a protective strip connected to said knife edge member and extending toward said door body on a side of said knife edge member away from said plunger for shielding said sealing strip from an opening of a coke oven to be closed by said door body.

13. A coke oven door construction according to claim 12 wherein said knife edge member has a second protrusion and said protective strip is welded to said second protrusion.

14. A coke oven door construction according to claim 13 wherein said knife edge member with said first mentioned protrusion and said second protrusion comprises a single drawn piece of material.

15. A coke oven door construction according to claim 14 wherein said knife edge member is connected to said plunger.

* * * * *